US011527398B2

(12) United States Patent
Hoyes

(10) Patent No.: US 11,527,398 B2
(45) Date of Patent: Dec. 13, 2022

(54) PULSED ACCELERATOR FOR TIME OF FLIGHT MASS SPECTROMETERS

(71) Applicant: HGSG LTD, High Peak (GB)

(72) Inventor: John Hoyes, High Peak (GB)

(73) Assignee: HGSG LTD, High (GB)

( * ) Notice: Subject to any disclaimer, the term of this patent is extended or adjusted under 35 U.S.C. 154(b) by 0 days.

(21) Appl. No.: 17/269,317

(22) PCT Filed: Jul. 8, 2019

(86) PCT No.: PCT/GB2019/000094
§ 371 (c)(1),
(2) Date: Feb. 18, 2021

(87) PCT Pub. No.: WO2020/044003
PCT Pub. Date: Mar. 5, 2020

(65) Prior Publication Data

US 2021/0313164 A1 Oct. 7, 2021

(30) Foreign Application Priority Data

Aug. 30, 2018 (GB) ..... 1814091

(51) Int. Cl.
*H01J 49/40* (2006.01)
*H01J 49/06* (2006.01)

(52) U.S. Cl.
CPC ..... *H01J 49/403* (2013.01); *H01J 49/062* (2013.01)

(58) Field of Classification Search
CPC ..... H01J 49/40; H01J 49/401; H01J 49/403; H01J 49/405; H01J 49/406; H01J 49/408
See application file for complete search history.

(56) References Cited

U.S. PATENT DOCUMENTS 5,847,385 A * 12/1998 Dresch ..... H01J 49/40 250/286
6,008,491 A 12/1999 Smentkowski
6,009,491 A 12/1999 Roppel
2010/0072362 A1* 3/2010 Giles ..... H01J 49/4295 250/287

(Continued)

FOREIGN PATENT DOCUMENTS

GB 2413213 A * 10/2005 ..... H01J 49/061
GB 2454767 A * 5/2009 ..... G01N 27/62

(Continued)

OTHER PUBLICATIONS

International Search Report dated Sep. 27, 2019 in corresponding PCT/GB2019/000094.

(Continued)

*Primary Examiner* — David E Smith
(74) *Attorney, Agent, or Firm* — Niels Haun; Dann, Dorfman, Herrell & Skillman, P.C.

(57) ABSTRACT

A pulsed accelerator for a Time of Flight mass spectrometers comprising a set of parallel electrodes. The accelerator is inclined at an oblique angle to the incoming ion beam defined by the ratio of the incoming ion beam velocity spreads axial and transverse to the beam. Additionally a deflection electrode is included to deflect unwanted ions away from the detector during the fill cycle of the accelerator.

15 Claims, 14 Drawing Sheets

(56) References Cited

U.S. PATENT DOCUMENTS

| | | | | |
|---|---|---|---|---|
| 2013/0056627 | A1* | 3/2013 | Verenchikov | H01J 49/406<br>250/282 |
| 2014/0339419 | A1* | 11/2014 | Thomson | H01J 49/067<br>250/282 |
| 2016/0284531 | A1* | 9/2016 | Zaks | H01J 49/0027 |
| 2018/0144920 | A1* | 5/2018 | Hoyes | H01J 49/004 |
| 2018/0366312 | A1* | 12/2018 | Hamish | H01J 49/405 |

FOREIGN PATENT DOCUMENTS

| | | |
|---|---|---|
| GB | 2538677 | 11/2016 |
| WO | 2007044969 | 4/2007 |
| WO | 2010018629 | 2/2010 |

OTHER PUBLICATIONS

GB Search Report dated Oct. 26, 2018 in corresponding GB Application No. GB1814091.3.

Conover C W S et al: "A Time-Of-Flight Mass Spectrometer for Large Molecular Clusters Produced in Supersonic Expansions"; Review of Scientific Instruments, AIP; vol. 60, No. 6; Jun. 1989; pp. 1065-1070.

Guilhaus Mass Spectrom Rev. Mar.-Apr. 2000; 19(2):65-107.

* cited by examiner

| Coordinate | x' | z' | x | z |
|---|---|---|---|---|
| Velocity m/s | $v_{x'} = 0$ | $v_{z'} = 3106$ | $v_x = 309$ | $v_z = 3090$ |
| Velocity Spread m/s | $\delta v_{x'} = 1.5$ | $\delta v_{z'} = 15$ | $\delta v_x \approx 1.5$ | $\delta v_z \approx 15$ |

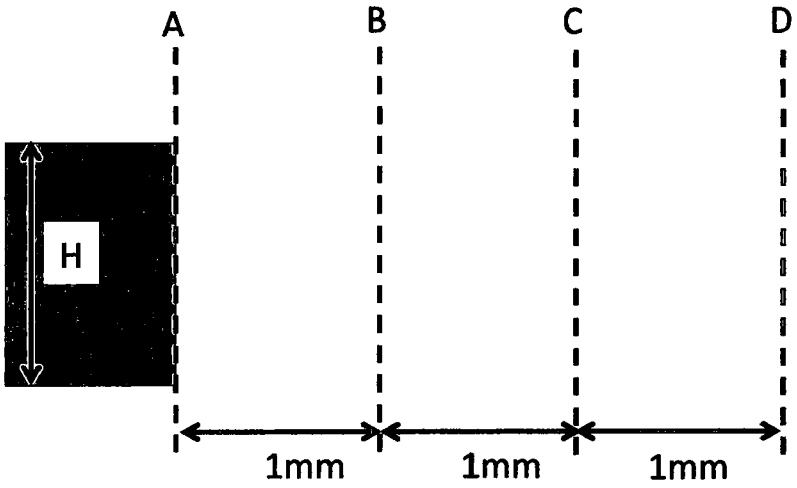
Figure 7b (t = 0)
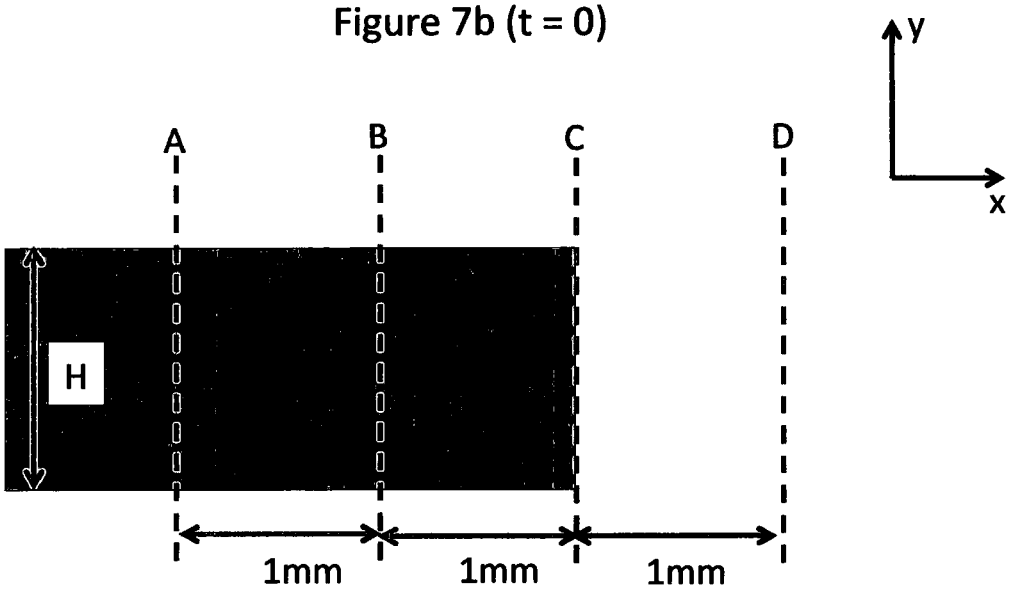
Figure 7b (t = 6.4μs)

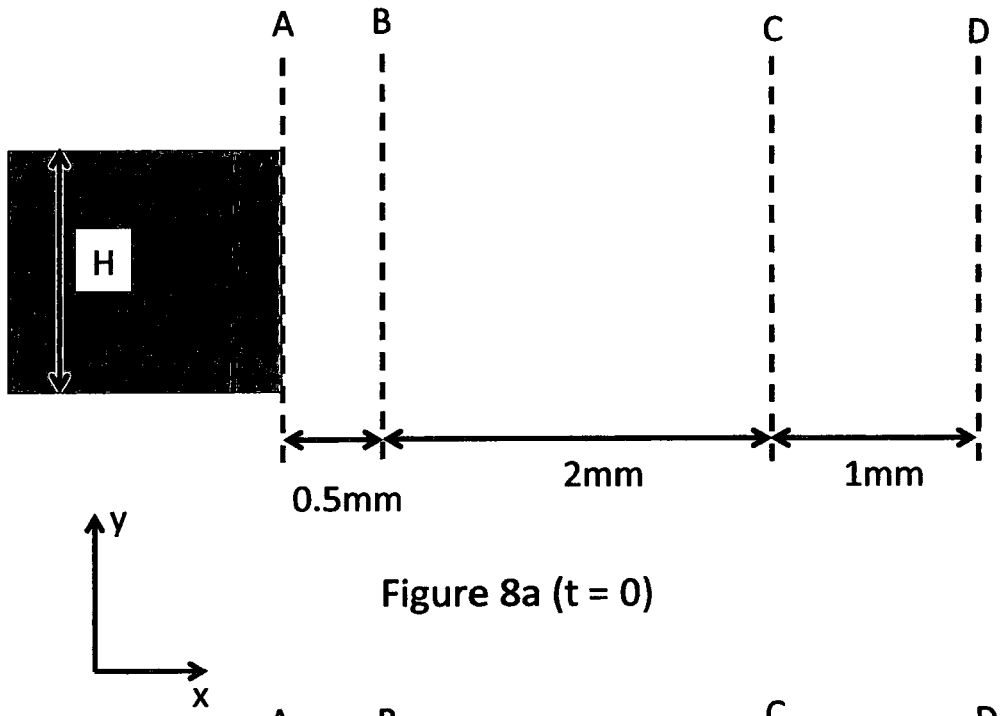
Figure 8a (t = 0)
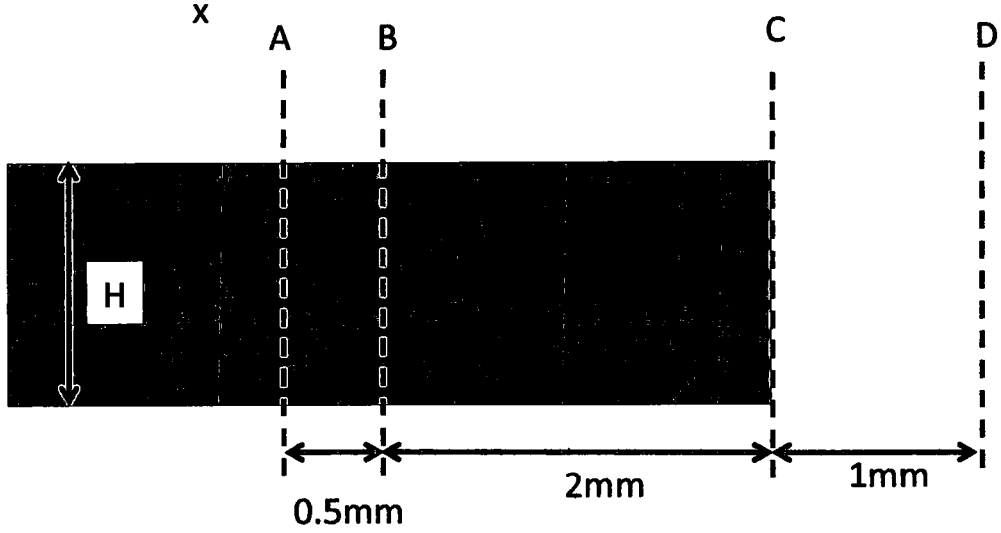
Figure 8b (t = 8μs)

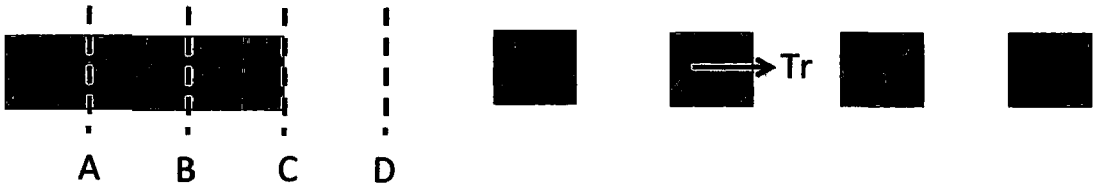
Figure 9a
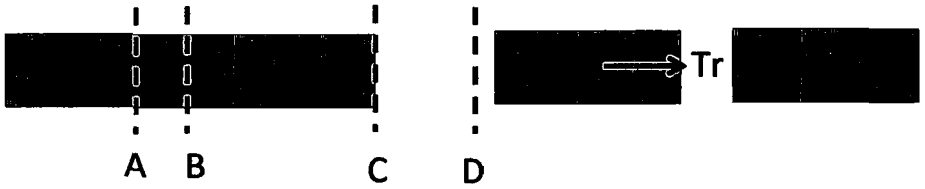
Figure 9b
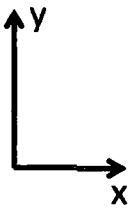

| Config | Mode | TOF (μS) | Ke (eV) | Sep (mm) | δz (mm) | EXP | θ° | Duty Cycle % | δt (ns) | FOM |
|---|---|---|---|---|---|---|---|---|---|---|
| Fig 2a | SP | 64 | 50 | 200 | 50 | 1 | 0 | 30 | 0.6 | 0.5 |
| Fig 2b | SP | 64 | 50 | 200 | 50 | 10 | 0 | 20 | 0.6 | 0.33 |
| OAA (Fig 8) | SP | 64 | 50 | 200 | 100 | 10 | 5.71 | 10 | 0.06 | 1.7 |
| OAA (Fig 8) | OS | 64 | 50 | 200 | 100 | 10 | 5.71 | 77 | 0.06 | 12.8 |
| OAA (Fig 8) | SP | 32 | 200 | 192 | 25 | 5 | 11.3 | 6.25 | 0.06 | 0.8 |
| OAA (Fig 8) | OS | 32 | 200 | 192 | 25 | 5 | 11.3 | 69 | 0.06 | 11.5 |
| OAA (Fig 8) | SP | 64 | 50 | 195 | 25 | 5 | 11.3 | 5 | 0.12 | 0.4 |
| OAA (Fig 8) | OS | 64 | 50 | 195 | 25 | 5 | 11.3 | 74 | 0.12 | 6.2 |

Figure 13

PULSED ACCELERATOR FOR TIME OF FLIGHT MASS SPECTROMETERS

PRIORITY APPLICATIONS

This application is a 371 application of International Application No. PCT/GB2019/000094 filed Jul. 8, 2019, which claims priority to United Kingdom Patent Application No. 1814091.3 filed Aug. 30, 2018. Each of the foregoing applications is hereby incorporated herein by reference.

This invention relates to an improved accelerator for continuous ion beams for Time of Flight mass spectrometers.

BACKGROUND TO PRESENT INVENTION

Time of Flight (TOF) mass spectrometers have found wide applicability in the trace analysis of chemical substances. They have been successfully integrated with liquid chromatography (LC) using Electrospray (ESI) and Atmospheric Chemical Ionisation (APCI) ion sources and have been commercially available for more than 20 years. Like all mass spectrometers speed of sample throughput is a key parameter in cost effective assays. Higher throughput means a reduction in costs due to lower electricity consumption per analysis and lower use of solvents and reagents which are expensive to buy and dispose of and may be damaging to the environment. Solvent usage is a particular problem in LC-MS systems with common solvents being used such as Acetonitrile and Methanol being toxic to humans and the environment. Legal and ethical disposal of waste solvents is a necessary but costly process. It is known that the most effective way to increase throughput for a mass spectrometer is to increase its sensitivity/resolution characteristic. Generally, increased sensitivity means lower levels of sample are required for analysis and increased resolution means more complicated samples can be analysed in faster assays. The instruments themselves are particularly useful in the environmental markets of pesticide analysis, food safety and water purity. It is an object of the present invention to increase sample throughput for TOF instruments and so make them more cost effective to run and less damaging to the environment.

The most common form of TOF instrument interfaced with continuous beam ion sources employ a technique known as orthogonal acceleration. In their simplest form these instruments consist of a pulsed acceleration stage orientated parallel to the incoming ion beam, a second static acceleration stage, a field free flight tube region and a detector placed at the end of the flight tube at the plane of greatest temporal compression (the so called isochronous plane). Resolution of these instruments can be increased by use of an ion mirror called a Reflectron. The Reflectron compensates for the energy spread imparted to the ion beam during the acceleration process. The pulsed acceleration stage operates at a high extraction field to minimise aberration due to the inherent upstream kinetic energy spread of the incoming ion beam prior to acceleration. This aberration is known as the turn around time. Unfortunately increasing the extraction field increases the energy spread imparted to the beam by the pulsed acceleration stage and there is a limit to how well the Reflectron can compensate for this energy spread. Balancing the conflicting requirements of high extraction field for low turn around time and low energy spread in the TOF analyser is the job of the TOF designer. These two parameters define the sensitivity/resolution characteristic of orthogonal acceleration TOF instruments.

State of the Art orthogonal acceleration instruments have typical duty cycles of 30% in conventional modes of sampling. Conventional sampling means waiting for the ions of maximum mass of interest to reach the detector before subsequent acceleration pulses. Oversampling techniques are where the ion accelerator is activated at a higher rate than the conventional mode. Oversampling techniques are employed to improve the duty cycle of these instruments further but do not address the turn around time aberration. Oversampling techniques are difficult to implement on conventional oa-TOF instruments due to the nature of their extended ion acceleration regions. However, such oversampling techniques are crucial to achieving high sensitivity on longer flight path TOF analysers such as folded flight path (FFP) instruments. High resolution is achieved in FFP instruments because the turn around time is a low proportion of overall flight time but these instruments are complex and expensive to produce.

It is an object of the present invention to simultaneously reduce the turn around time aberration and increase the duty cycle of TOF mass spectrometers. The improvement of the sensitivity/resolution characteristic of state of the art TOF instruments is increased by an order of magnitude with consequential increase sample throughput. We define a figure of merit (FOM) for TOF instruments as the ratio of the Duty Cycle of the TOF to the Turn around Time in the acceleration region.

SUMMARY OF INVENTION

The present invention comprises a set of parallel electrodes arranged to accelerate an ion beam into a TOF mass analyser. In contrast to orthogonal acceleration where the ions enter the accelerator parallel to the electrodes, in the present invention the electrodes are inclined at an oblique angle to the incoming beam. This angle allows a slice of the entire ion beam to be sampled by the accelerator even if said ion beam is expanded to several millimetres in diameter. There is a vector contribution to the turn around time from both the axial and transverse velocity spreads of the upstream incoming ion beam. This is in contrast to orthogonal acceleration case whereby only transverse velocity spreads contribute to the turn around time. The oblique angle of incidence however, allows the full width of an expanded ion beam to be sampled with a high extraction field in the direction of the TOF analyser which is not possible with the orthogonal accelerator. Due to this angle of incidence ions fill up the extraction region more quickly than in the orthogonal case. In order to achieve the highest duty cycle of ion beam sampling the downstream TOF analyser is preferably operated in an oversampled mode where the pusher repetition rate exceeds that of the time of flight of the maximum mass of ions to be analysed. Ions typically emanate from upstream RF cooling devices and beam conditioning is employed to control the ratio of the transverse to axial energy spreads in the beam. Transverse expansion of the ion beam by a certain factor leads to a consequential reduction in velocity spread by the same factor in said transverse direction, this is a due to conservation of phase space known as Liouville's theorem. Ions preferably enter the accelerator through the rear of the first of a set of parallel electrodes and fill up the acceleration region. The parallel electrodes are preferably inclined to the incoming ion beam at an angle $\theta=\tan^{-1}(\delta v_x/\delta v_z)$, where $\delta v_z$ and $\delta v_x$ are the axial and transverse velocity spreads of said incoming ion beam. The electrodes are at least semi-transparent to the ion beam and may consist of grids, meshes or slit electrodes. During the fill up part of the cycle unwanted lower mass ions are prevented from reaching the detector by use of a deflector in the accelerator that preferably takes the form of a Bradbury Nielson ion gate. Ions are then accelerated into the TOF by application of pulsed voltages to the electrode set. Voltages are then reduced and the fill up part of the cycle begins again.

According to a first aspect of the present invention there is provided a pulsed acceleration stage for a TOF mass spectrometer comprising:

A set of parallel electrodes arranged and adapted to receive and accelerate ions into a TOF mass spectrometer.

Whereby the said set of electrodes are inclined at an oblique angle to the incoming ion beam.

According to another aspect of the present invention the TOF takes the form of a conventional Reflectron TOF analyser or Electrostatic Sector analysers or a combination both.

According to another aspect of the present invention the electrode set is semi transparent to the incoming and accelerated ion beams. Preferably said electrode set comprises grid or wire meshes or slit diaphragms or a combination of grid or wire meshes and slit diaphragms.

According to another aspect of the present invention there is provided a means for preventing unwanted ions from reaching the detector of said mass spectrometer whereby said means comprises:

An ion deflection device to deflect ions away from said ion detector. Preferably said deflection means takes the form of a Bradbury Nielson ion gate. Other less preferable deflection or filtering means are also contemplated below.

According to another aspect of the present invention there is provided an upstream ion beam conditioning device to arrange for a desired ratio of axial and transverse velocity spreads, $\delta v_x$ and $\delta v_z$ of said incoming ion beam. Preferably said upstream ion beam conditioning device takes the form of a beam expander. The beam may also be expanded in the y direction to reduce space the charge density of the beam and the $\delta v_y$ velocity spread.

According to another aspect of the present invention there is provided an electrode to prevent perturbation of the incoming ion beam during the acceleration cycle of the TOF. Preferably said electrode takes the form of a grid or mesh of wires or a slit.

According to another aspect of the present invention said parallel electrodes are inclined to the incoming ion beam at an angle $\theta=\tan^{-1}(\delta v_x/\delta v_z)$, where $\delta v_z$ and $\delta v_x$ are the axial and transverse velocity spreads of said incoming ion beam.

According to another aspect of the present invention there is provided a means for preventing unwanted ions from reaching the detector of the said mass spectrometer whereby said means comprises:

An ion deflection device to deflect ions away from said ion detector. Whereby said deflection means takes the form of a pair of pulsed deflection plates located downstream of said acceleration stage.

According to another aspect of the present invention there is provided a means for preventing unwanted ions from reaching the detector of the said mass spectrometer whereby said means comprises:

An ion filtering mechanism placed in the flight tube of the TOF mass spectrometer. Whereby said filtering mechanism takes the from of an aperture.

According to another aspect of the present invention there is provided a means for preventing unwanted ions from reaching the detector of the said mass spectrometer whereby said means comprises:

An ion filtering mechanism placed downstream of the said acceleration stage mass spectrometer.

Whereby said filtering mechanism takes the from of an Electrostatic analyser (ESA).

According to another aspect of the present invention said ion accelerator is operated in an oversampled manner whereby the time between consecutive acceleration pulses is less than the time-of-flight of the ions in the mass spectrometer.

According to another aspect of the present invention the upstream ion beam emanates from an RF cooling device arranged to minimise energy spreads in the transverse and axial directions. Preferably the amplitude of the RF field is gradually spatially reduced or temporarily switched to zero during the extraction of said upstream ion beam.

According to another aspect of the present invention said accelerator is coupled to an upstream time nested physicochemical separation technique. Whereby said such physicochemical separator is preferably an ion mobility separator or a mass to charge dependent separator.

LIST OF FIGURES

FIG. 7 shows the view of FIG. 6 and aids duty cycle explanation.

FIG. 8 shows a second embodiment with a further increase in duty cycle.

FIG. 9 shows how the embodiments of FIGS. 7 & 8 may be operated in multiplexed mode for higher duty cycles.

FIG. 13 shows a table summarising the advantages of the present invention over the Prior Art.

DETAILED DESCRIPTION OF INVENTION

Figure 1A:
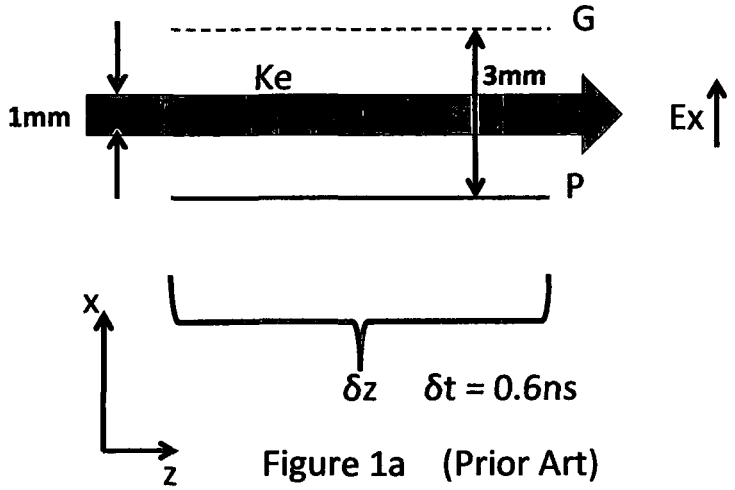
Figure 1a (Prior Art)
FIG. 1 shows the prior art of orthogonal extraction and its advantage over axial extraction.

Orthogonal acceleration of continuous ion beams such as those generated from ESI, APCI or electron impact (EI) ion sources is the standard technique to interface these beams with Time-of-Flight (TOF) analysers which require pulsed ion beams in order to operate successfully. An ion beam is directed in between a pair of parallel electrodes elongated in the (z) direction of the beam (known as the pusher) and the region is allowed to fill with ions. A pulsed extraction voltage is periodically applied to these electrodes and an acceleration field orthogonal to the initial direction of the beam is imparted. The beam subsequently enters the TOF analyser retaining the initial (pre acceleration) z component of velocity with the beam being compressed by the action of the TOF analyser in the orthogonal (x) direction. A detector is placed at the (YZ) plane of greatest temporal compression (the so called isochronous plane) to achieve the highest possible mass resolution. State of the art oa-TOF analysers typically operate with ion beam widths of δx, between 1-2 mm and beam lengths δz, of around to 50 mm. Extraction field strengths between 500V/mm and 1000V/mm are typical which leads to energy variation δK, of between 500 and 2000 eV (singly charged ion) in the TOF analyser. Such energy spreads are sufficiently compensated for by use of a combination of two (or more) stages of extraction, and by the use of one or two stage reflectrons. There remains however, another aberration due to the velocity spread of the beam in the TOF (x) direction due to the inherent energy spread in the incoming ion beam. This is known as the "Turn around Time", δt and in many cases is the limiting aberration in achieving high resolution in the TOF analyser. For an ion of mass, m charge q with a velocity spread $\pm\delta v_x$ experiencing an initial acceleration field Ex it is given by the equation:

$$\delta t=2m\delta v_x/qEx \qquad \text{Equation (1)}$$

Where m is mass, and q the charge of the ion. It can be reduced in magnitude by increasing Ex or reducing $\delta v_x$ and it has long been the focus of TOF designers to reduce this aberration to acceptable levels.

In Electrospray TOF instruments the incoming ion beam usually emanates from a radio frequency (RF) ion guide which acts to collisionally cool and focus the ion beam in preparation for TOF analysis. These ion guides typically impart energies of around ±0.5 eV (full spread in all directions) to the ions before they are accelerated into the pusher region at an energy Ke known as the entrance energy. Given the initial energy spread, Ko of 0.5 eV in the RF guide we can work out the velocity spread in the beam in the pusher using the following equation:

$$2\delta v_0=(2q/m)^{1/2}[(Ke+Ko)^{1/2}-(Ke-Ko)^{1/2}] \qquad \text{Equation (2)}$$

For a species of m/q=1000 Th and entrance energy Ke of 50 eV, this corresponds to a velocity spread in the ion guide of $\delta v_0\approx\pm15$ m/s assuming an isotropic spread. For an acceleration field Ex of 500V/mm and using equation (1) gives a value for the turn around time of ≈0.6 ns. In the analysis that follows all values relate to this initial ±0.5 eV spread and an m/q value of 1000 Th. The fraction of the incoming ion beam that is sampled by the TOF accelerator is known as the "Duty Cycle", it is calculated for the maximum mass of interest (1000 Th) and is typically around 30% for conventional orthogonal TOF instruments known in the prior art. For a comprehensive review on the subject see the paper by Guilhaus Mass Spectrom Rev. 2000 March-April; 19(2):65-107 incorporated by reference herein.

The present invention describes a method for improving the duty cycle of pulsed beam TOF mass spectrometers while reducing the value of the turnaround time. The combination of these two effects is to improve the resolution and sensitivity of the instrument, which is advantageous for the operation of these mass spectrometers. The invention consists of two or more parallel electrodes inclined at an oblique angle to the incoming ion beam. The ion beam is allowed to fill the extraction region before an accelerating field is generated by applying a pulsed voltage to one or more of the electrodes. Ions enter at an oblique angle through the rear of the first Gaurd electrode (A), then they pass through the second Pusher electrode (B) and reach the third Gate electrode (C) to fill up the acceleration region prior to pulsed extraction through the fourth Puller electrode (D). Preferably the electrodes take the form of a mesh or grid of wires. During the fill cycle the third electrode may also act as a deflector to prevent unwanted ions that are accelerated by the second (static) stage reaching the detector. These unwanted ions would otherwise create an unfocused background signal which would reduced the detector lifetime and deteriorate mass spectral signal to noise ratio. Preferably the said Gate electrode takes the form of a Bradbury-Nielson ion gate whereby ion deflection is achieved by applying alternate polarity voltages to adjacent parallel wires. The Bradbury-Nielson ion gate is used due to the fast spatial decay of its fringe fields in operation making it an "optically thin" device which is advantageous for the operation of this invention. When the fill cycle is complete the deflection voltage is turned off simultaneously with the application of the pulsed extraction voltage to the Pusher and fourth (Puller) electrodes. For ions of initial velocity spread $\delta v_x$ and $\delta v_z$ (transverse and axial to the incoming ion beam respectively) the accelerator is preferably inclined at an angle θ such that:

$$\theta=\tan^{-1}(\delta v_x/\delta v_z) \qquad \text{Equation (3)}$$

If the velocity spreads $\delta v_x$ and $\delta v_z$ are equal then θ=45. The angle is chosen such that the vector component contribution from the two velocity spreads to the total turn around time, δt is equal:

$$\delta v_x \operatorname{Cos}(\theta)=\delta v_z \operatorname{Sin}(\theta) \qquad \text{Equation(4)}$$

If it is arranged by upstream beam conditioning that the two velocity spreads are different, e.g. $\delta v_x=0.1\delta v_z$ then θ=5.71 degrees. In this situation employing an acceleration field Ex of 500V/mm the results in a ten fold reduction in turn around time, δt to 0.06 ns when compared to the 0.6 ns of the prior art.

Figure 1B:
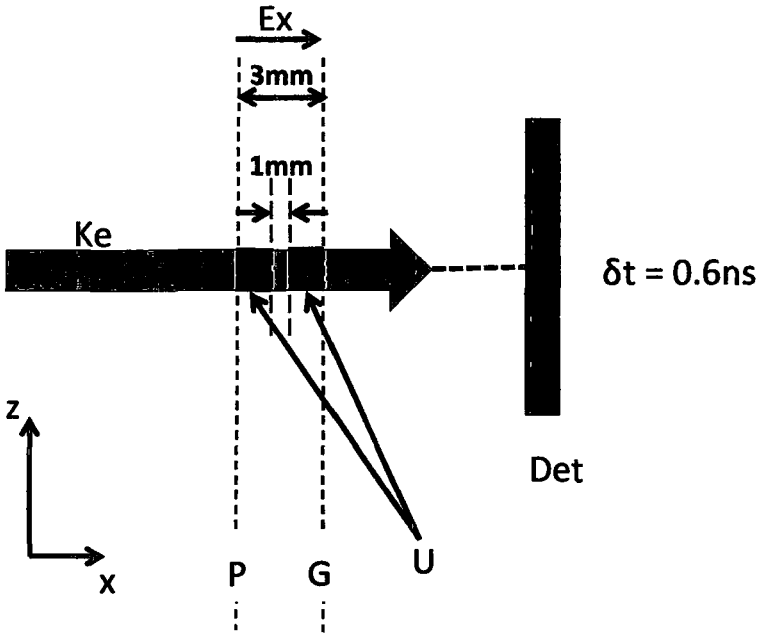
Figure 1b (Prior Art)

In order to quantitatively understand the advantages of the present invention it is useful to compare a set of standard parameters typically used in prior art orthogonal acceleration instruments. FIG. 1*a* shows such a prior art embodiment whereby a 1 mm wide beam (ion beams are shown in grey) (δx), is accelerated in a 500V/mm field (Ex) between a pusher electrode (P) and grid (G) with a physical extent (δz) of 50 mm. The resulting 500 eV energy spread (δK) of ions in the TOF analyser is relatively modest and is easily accommodated by state of the art TOF analysers. In the example of FIG. 1*a* the incoming ion beam has an energy Ke=50 eV (for a singly charged species) in the z direction. In this example the turn around time δt was calculated in the background section to be 0.6 nS. Prudent placement of an ion detector adjacent to the pusher region leads to duty cycles of around 30% which is well known to those skilled in the art. FIG. 1*b* shows the disadvantage of axial acceleration in terms of duty cycle with a short physical extent (δz) and the creation of unwanted species U, which have direct line of sight to the detector (Det).

Figure 2:
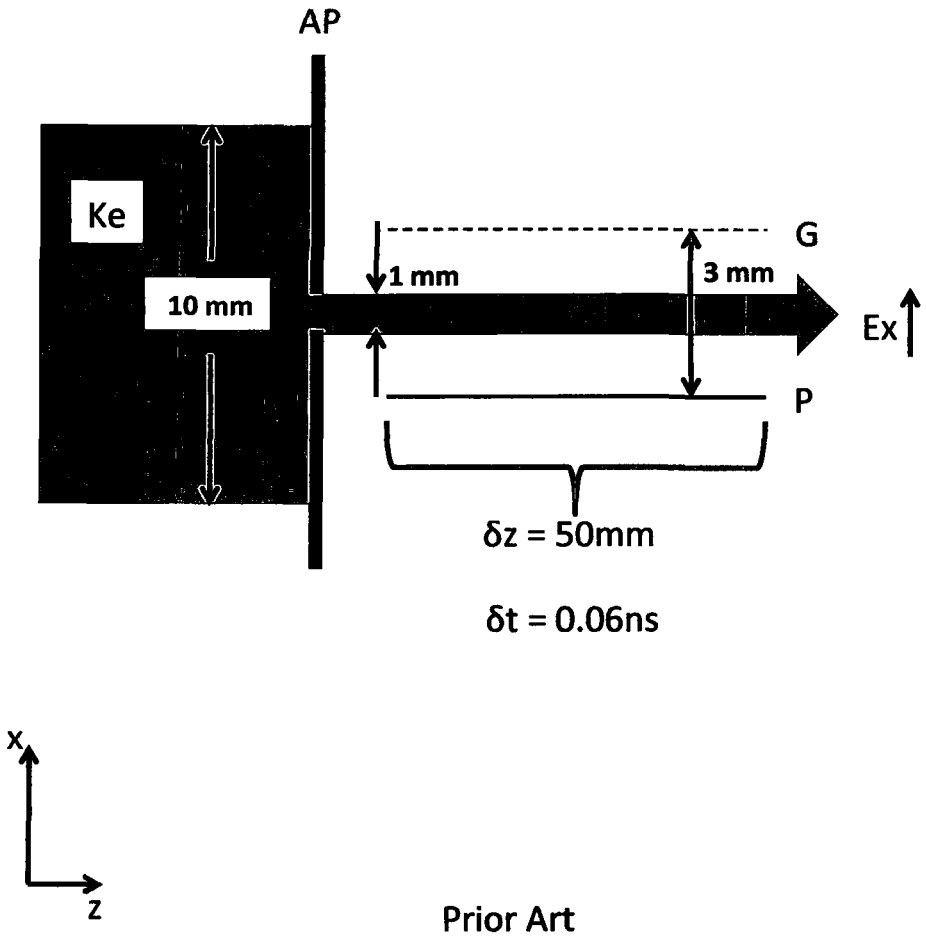
FIG. 2 shows how expanding an ion beam upstream of the accelerator leads to lowering of turn around time at the expense of ion transmission.

FIG. 2 shows how an upstream beam expansion of a factor of ten leads to reduction of turnaround time if the same extraction field Ex=500V/mm is applied, this conservation of phase space is a direct consequence of Liouville's Theorem. Unfortunately such an embodiment only samples 10% of the incoming ion beam through the aperture (AP) and so the overall transmission of the instrument is reduced.

Figure 3:
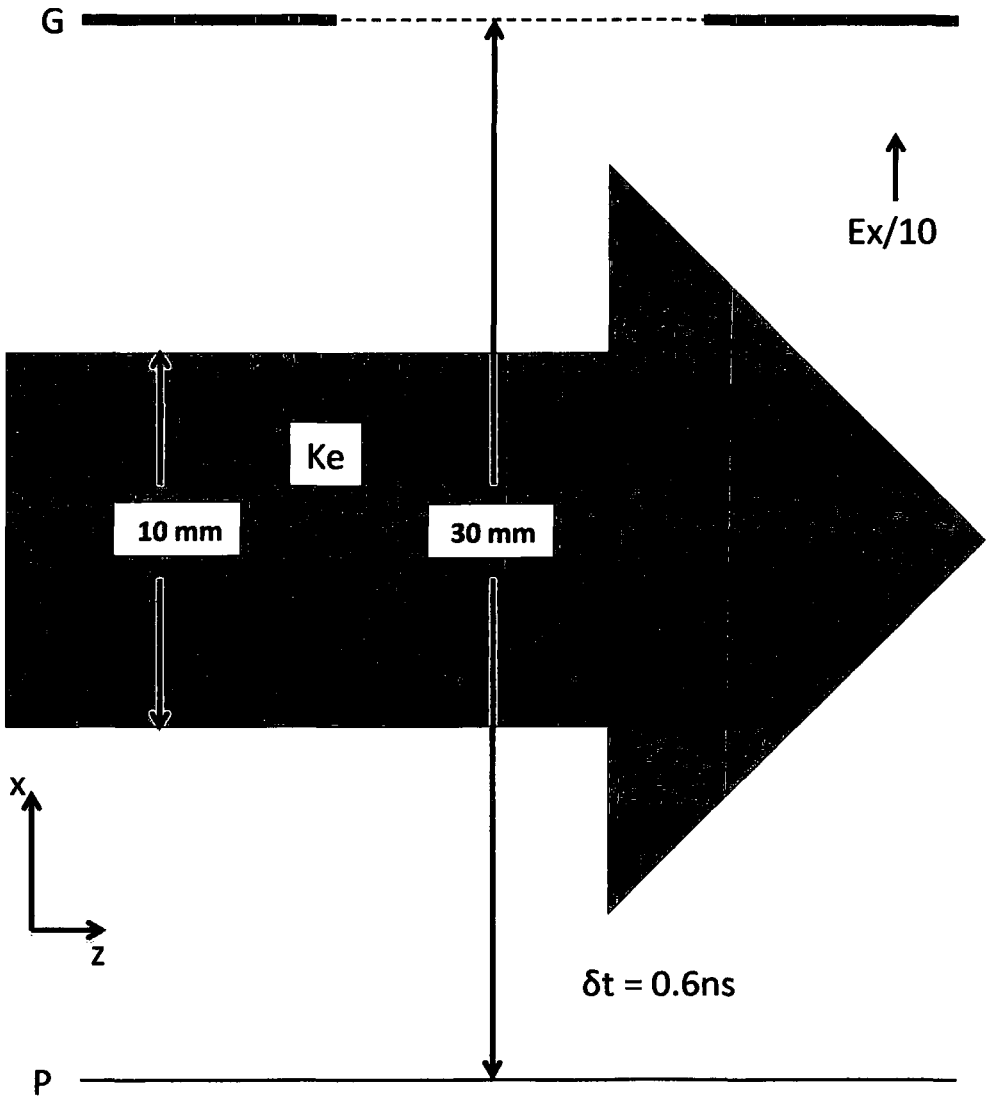
Prior Art Figure 3
FIG. 3 shows how an expanded ion beam may be orthogonally sampled, but the turnaround time is unchanged from FIG. 1.

FIG. 3 shows how an 10× expanded beam may be accommodated by an acceleration stage. In this case the extraction field is reduced by a factor of ten (Ex/10) and the Pusher to Grid distance increased for the same δK=500 eV analyser energy acceptance. In consequence the turnaround time remains the same value of 0.6 ns. so the advantage of this geometry lies only in simplification of instrumentation with no inherent duty cycle/turnaround time advantage.

Figure 4:
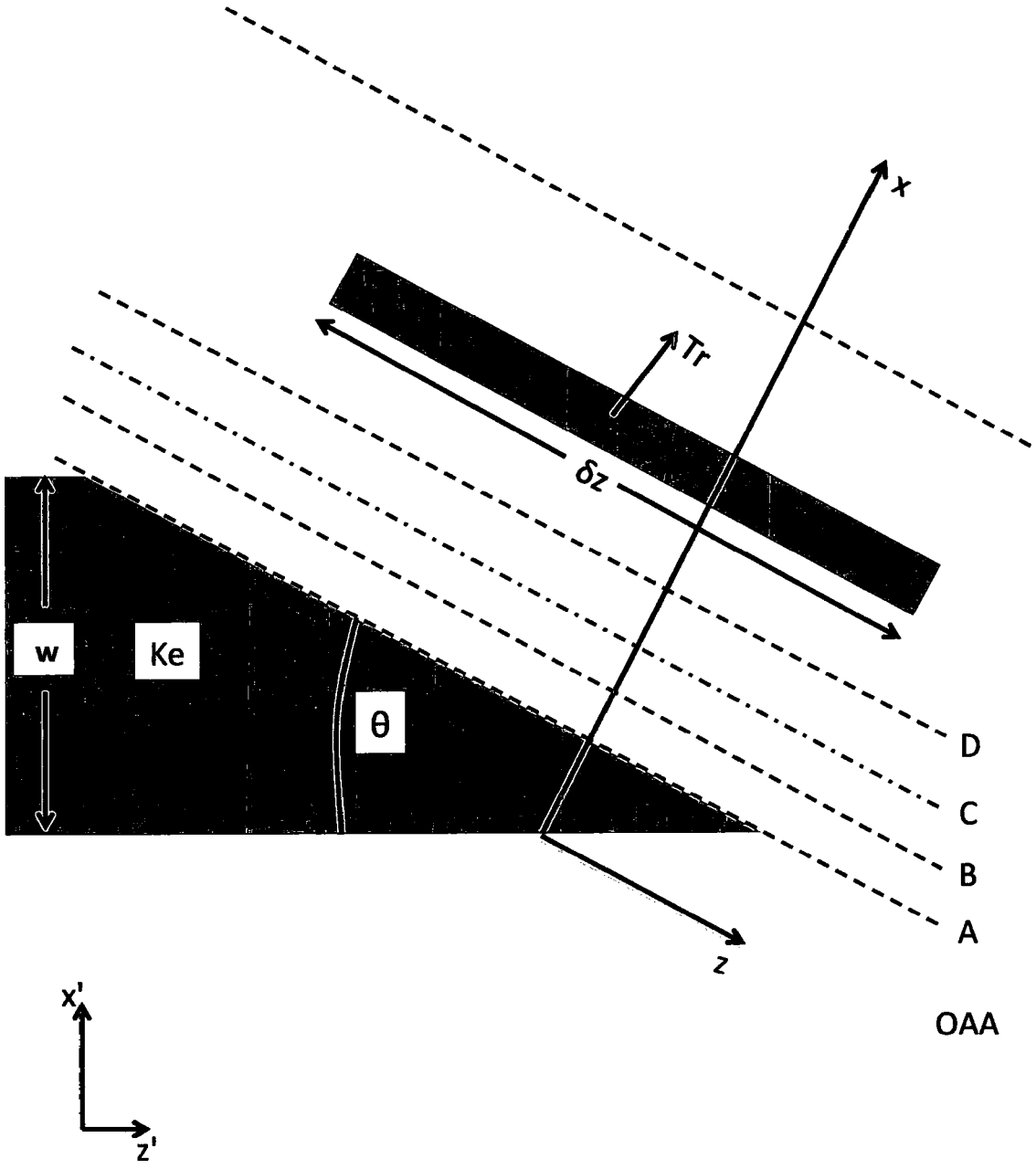
FIG. 4 shows the first preferred embodiment of the present invention whereby ions enter the accelerator at an oblique angle.

FIG. 4 shows the essential features of the invention. An incoming ion beam of width, w enters the accelerator with a kinetic energy, Ke at an angle θ to the accelerator. The beam is allowed to fill the accelerator with ions up to a Gate electrode and a slice of ions of width δz is subsequently accelerated into the TOF analyser. The trajectory (Tr) taken by the ion beam is a vector summation of the incoming trajectory, Ke and the energy imparted by the TOF analyser. Electrodes of the oblique angle accelerator (OAA) are shown in dashed lines. The OAA consists of four electrodes; Guard electrode (A), Pusher electrode (B), Gate electrode (C) and Puller electrode (D).

Figures 5A, 5B:
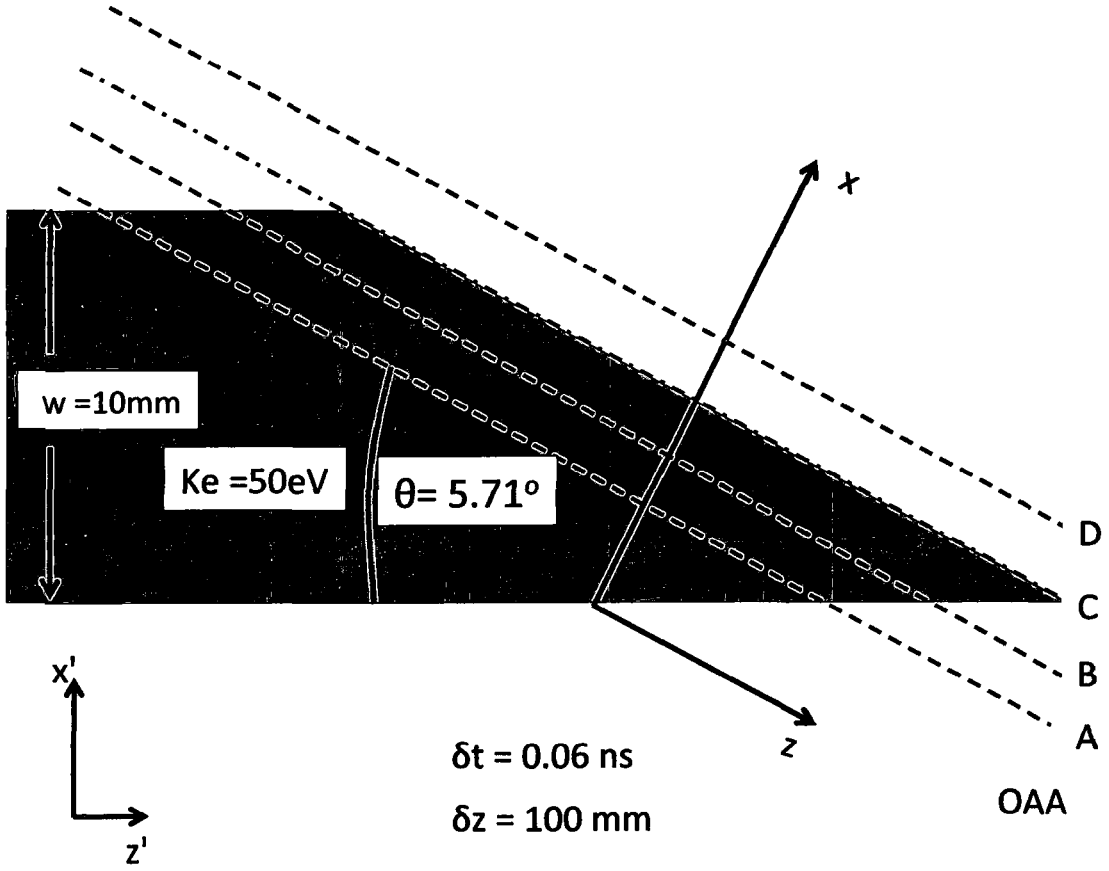
FIG. 5 shows a preferred embodiment of the present invention immediately prior to ion acceleration.

FIG. 5*a* shows a first preferred embodiment of the present invention immediately prior to the acceleration of the ions. If a 10× expansion (EXP) of a 1 mm beam is employed then beam width w=10 mm, $\delta v_x=0.1\delta v_2$, and θ=5.71 degrees as described above. We can see by geometrical considerations that in order to sample the whole of the 10 mm expanded beam at this angle a longer pusher region is needed to accommodate a δz of 100 mm. We adopt the notation x', y' and z' for the incoming ion beam axes and x, y, and z for the TOF axes, where x is the direction of time of flight beam compression. Ions enter through the back of a guard electrode (A), pass through the pusher electrode (B) and reach the deflection electrode (C). The diagram shows the moment of acceleration when the region between B and C is full of ions. Application of the Ex=500 V/mm acceleration field yields (by vector considerations) a turn around time, δt of 0.06 ns, which is ten times smaller than the orthogonal acceleration example of the prior art shown in FIG. 1. Note that there is an additional component of velocity $v_x$ in the direction, x of the TOF analyser but this small velocity does not affect TOF operation in any adverse way. There remains a z component of velocity $v_z$ that must be taken into account for detector positioning. After acceleration the ion beam passes through another electrode, D commonly known in the prior art as a Puller and into a second static stage of acceleration before entering the flight tube of the TOF, as shown in FIG. 4. Electrodes A, B, C and D must be partially transparent to the ion beam, preferably these electrodes consist of parallel wires orientated along the z-axis of the TOF. Such electrodes are commonly used in orthogonal TOF instruments with typical ion transmission figures exceeding 90% per element. Note that the ion trajectory in the TOF is a vector addition of the incoming ion beam trajectory and energy imparted by the TOF analyser as indicated in the diagram. It should be understood that the present invention employs no steering electrodes which are known in the prior art to be detrimental to instrument resolution. Less preferably deflection could be achieved by supplementary electrode set such as a pair of electrodes arranged after the Puller (D) to deflect the beam in the y direction. FIG. 5*b* shows the velocity components and spreads calculated according to the analysis described above.

Figure 6A:
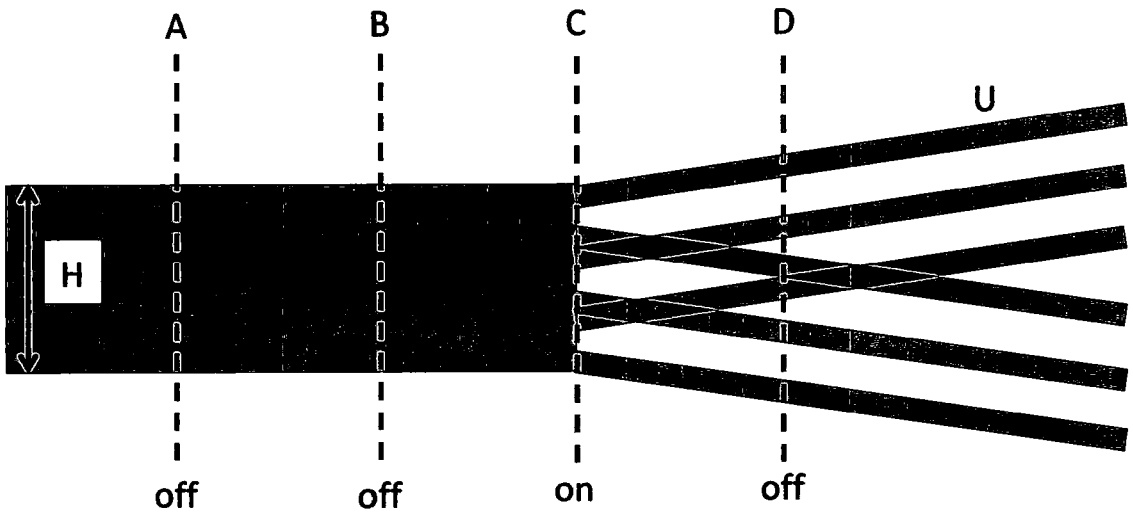
FIG. 6 shows the extraction process in an alternative plane illustrating the operation of the gate electrode.
Figure 6B:
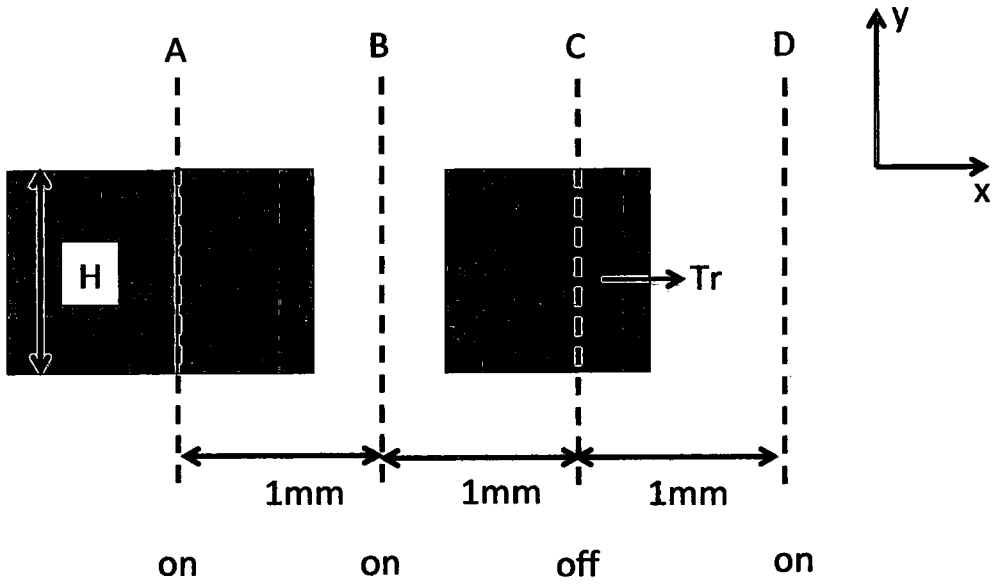

Referring now to FIG. 6 we can examine the fill and extraction cycle further. This diagram shows an x-y cross section of the embodiment of Figure's 4 & 5. During the fill cycle shown in FIG. 6*a* unwanted ions (U) that reach the Gate (C) are deflected so as to avoid hitting the TOF detector. The height of the beam (H) is typically 1 mm, but this may be increased to reduce any possible charging effect on the electrodes (by reducing ion beam density). FIG. 6*b* shows that during acceleration cycle the Gate (C) deflection is switched off and ions between Pusher (B) and Gate (C) experience a forward 500V/mm field (Ex) towards the TOF analyser. During this time ions between Guard (A) and Pusher (B) experience a backward field and are repelled to the Guard electrode. The purpose of the Guard electrode (A) is to prevent the incoming ion beam being deflected by the stray backward field from the Pusher (B) when the instrument is in the extraction cycle. The distance between the Guard (A) and Pusher (B) should be as short as possible to maximise instrument duty cycle.

FIG. 7 shows that the fill cycle time for the embodiment of FIG. 6 is 6.4 μs to allow ions to fly from Guard (A) to Gate (C) in a substantially zero value field. During the acceleration cycle the potential of the Guard (A) may be raised slightly to compensate for the field penetration between itself and the Pusher leaking into the upstream region, this has the effect of minimising the perturbation of the incoming ion beam during this time. In this example 3.2 μs of incoming beam is sampled by the instrument leading to a duty cycle of 3.2 μs/(Time of Flight) when operated in conventional single push mode. FIG. 8 shows a further embodiment whereby a 2 mm width (δx) is sampled and the Guard (A) to Pusher (B) distance is reduced to 0.5 mm leading to a doubling in single push duty cycle. In this case δK is increased to 1000 eV which is still well within reach of accomodatable energy spreads in state of the art TOF analysers.

FIGS. 9*a* and 9*b* shows how the embodiments of FIGS. 7 & 8 respectively may be operated in a an oversampled or Multiplexed mode. Multiplexing (or oversampling) is where the TOF pusher is activated a frequency higher than that associated with the fight time of the ions of interest. The resulting acquired spectra may be demultiplexed for higher duty cycles, such techniques are well known in the prior art. Maximum achievable pusher (acceleration) frequency is calculated by working out how long it takes to fill the region from Guard (A) to Gate (C) plus the extraction time of the ions from the rear of the Pusher (B) to the exit of the Puller (D). It can be seen that very high duty cycles are achievable in this mode whilst maintaining the low turn around times as illustrated in FIG. 4, this combination of high duty cycle and low turn around times is the main advantage of the present invention. The effect of reducing the Guard (A) to Pusher (B) distance to 0.5 mm coupled with a 2 mm Pusher (B) to Gate (C) distance improves the maximum multiplexed duty cycle further to a value of 77% for the 1000 Th ion.

Figure 10:
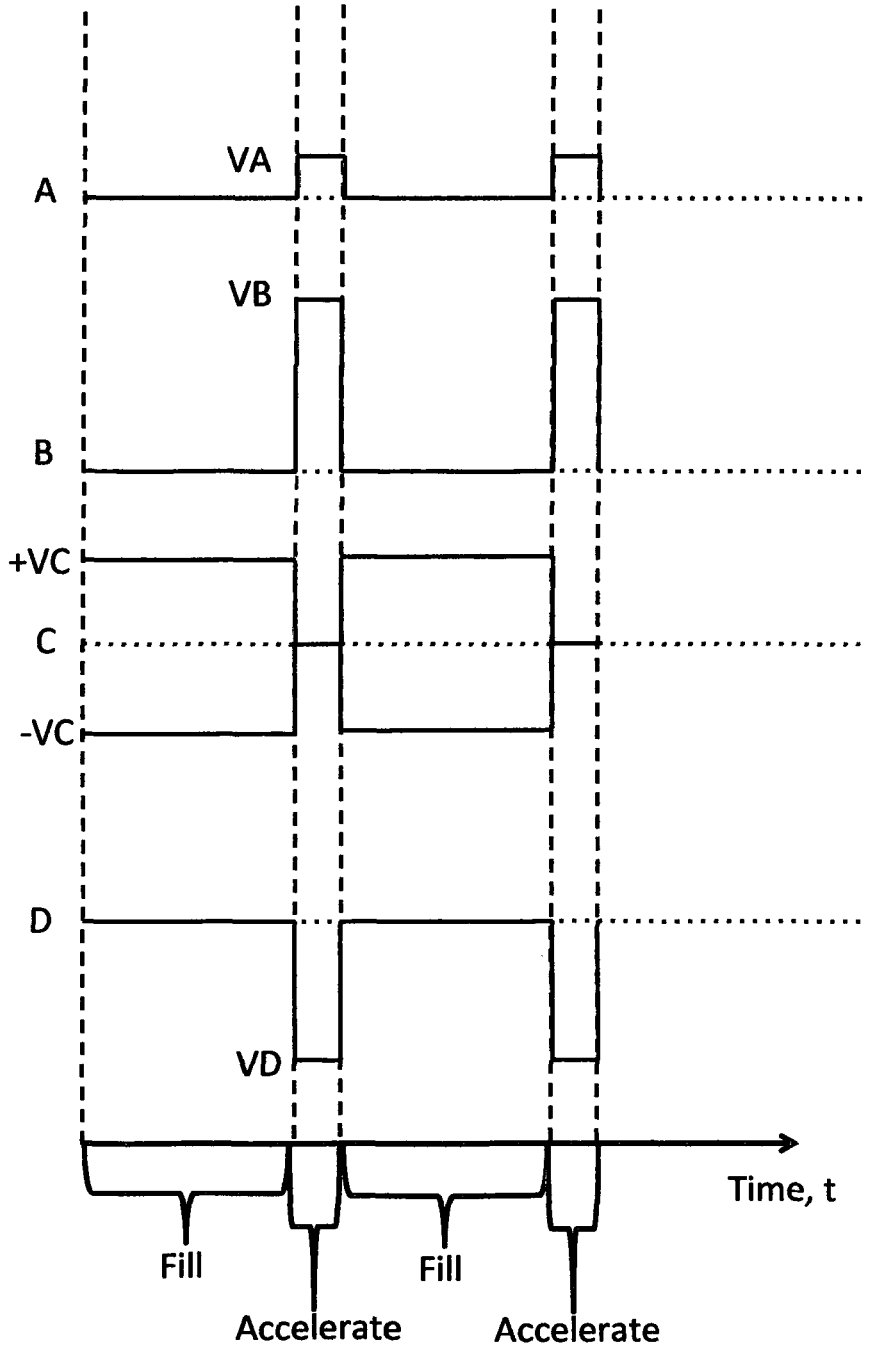
FIG. 10 shows a timing diagram for the voltages of the electrodes embodiment of FIG. 7

FIG. 10 shows a schematic timing diagram for the OAA. During the fill cycle the Gate (C) is activated by applying ±VC to its electrodes to deflect unwanted ions. During the acceleration cycle the Gate (C) is switched off and Guard (A), Pusher (B) and Puller (D) have voltages VA, VB and VD applied respectively. The Guard electrode (A) preferably has a small potential VA applied to prevent perturbation of the incoming ion beam during the acceleration cycle. In the preferred embodiment shown in FIG. 7 this equates to a maximum multiplexed pusher rate of 150 Khz, but the time between consecutive pushes, T can be varied according to the desired time, e.g. single push or lower desired multiplexing rate.

Figure 11:
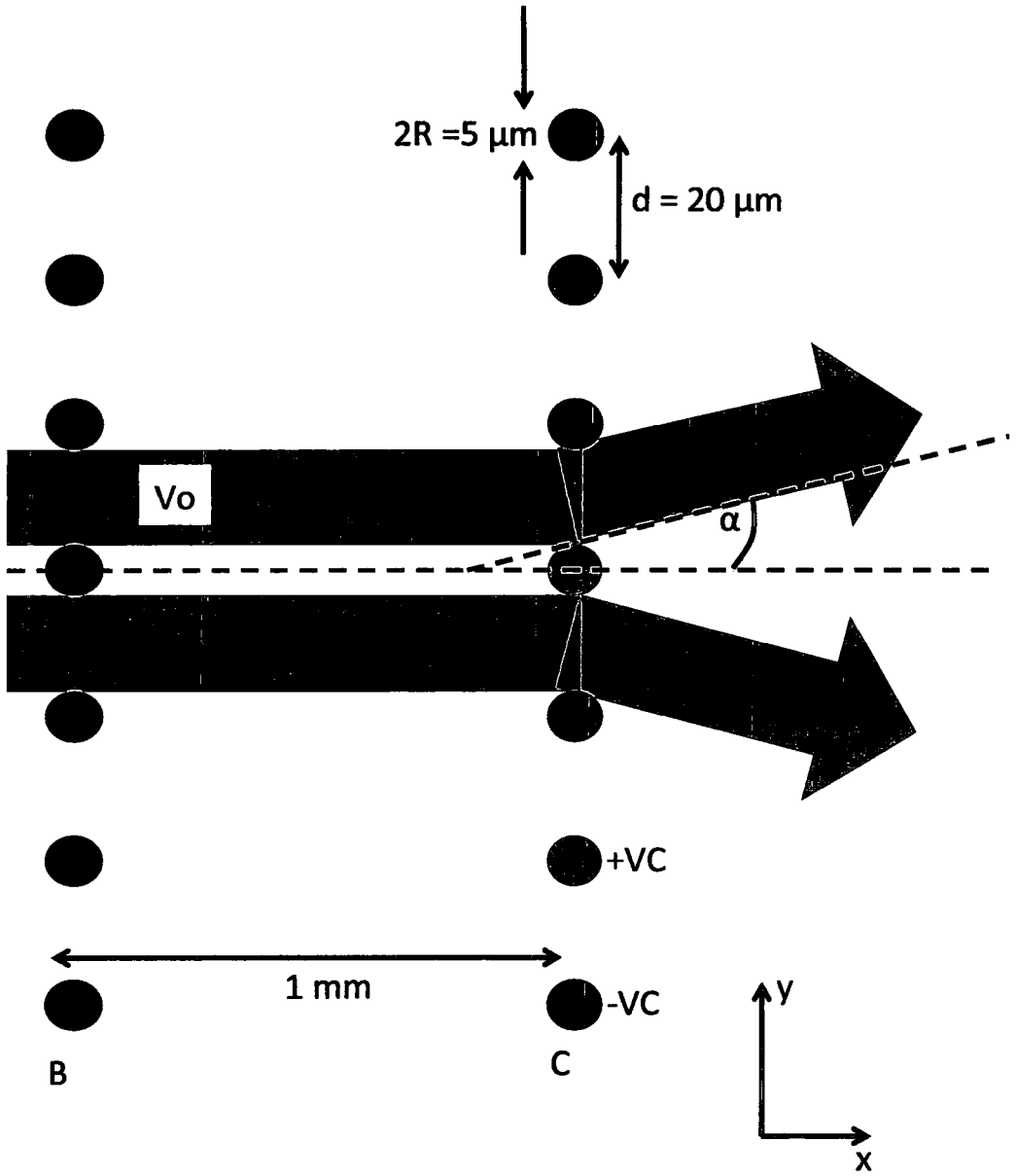
FIG. 11 shows a detailed description of the operation of the gate electrode as a deflector

FIG. 11 show the operation of the Gate (C) in greater detail. The Gate is configured as a Bradbury-Neilson (BN) ion gate in the fill cycle. In order to allow a maximum mass of interest (chosen as 1000 Th in our worked example) to reach the Gate (C) electrode the lower mass ions (less than 1000 Th) will have already reached and passed the Gate (C). These are the unwanted ions (U) that are prevented from reaching the detector by the deflection action of the Gate (C). In this figure the grid wires of the gate are chosen to be 2.5 μm radius, (R) diameter with a 20 μm pitch (d). Such a device is feasible to construct and is known in the prior art. The operation of the Gate is not challenging in terms of voltage requirements, this can be understood by vector considerations. The relative incoming velocity to the gate can be calculated by vector considerations and is only 309 m/s for a Ke=50 eV corresponding to a low energy of only 0.5 eV for our 1000 Th ion. The equations for the deflection angle (α) for a BN gate is given by:

$$\tan(\alpha)=k\ VC/Vo,\ \text{where}\ k=n/2\ \mathrm{Ln}[\mathrm{Cot}(nR/2d)] \qquad \text{Equation (5)}$$

where Vo is the relative incoming beam energy, and VC is the Gate voltage. Only 0.25V is required to deflect the beam by 19 degrees which corresponds to a velocity of 151 m/s in the y direction. This corresponds to a 9.7 mm y displacement for a typical flight time of 64 μS ion which is sufficient to deflect the bean away from the detector.

Figure 12:
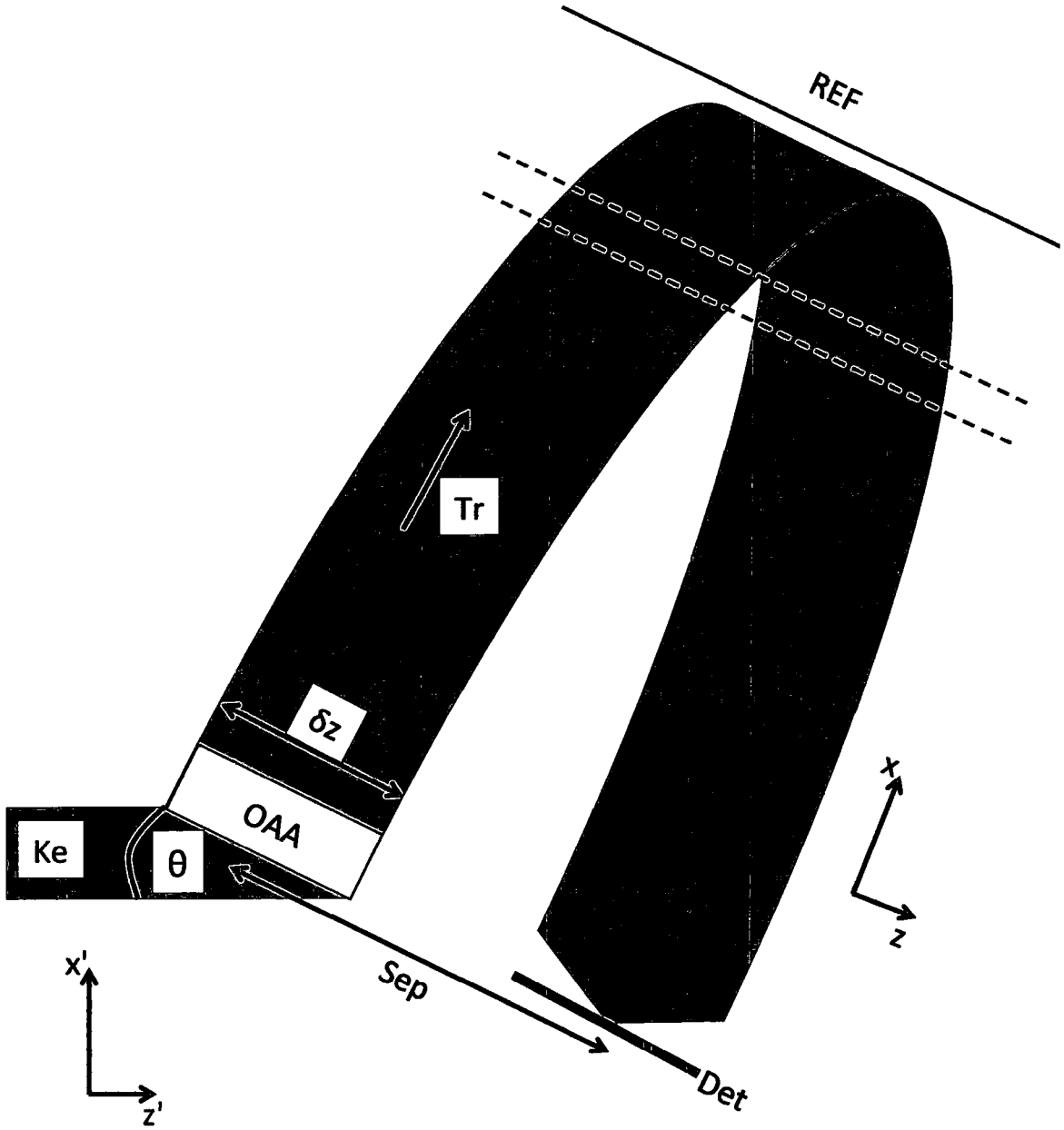
FIG. 12 shows a preferred embodiment of the invention and its incorporation in a full instrument.

FIG. 12 shows the preferred embodiment of FIG. 4 and its incorporation into a complete Reflectron (REF) TOF instrument. The essential parameters are incoming ion beam energy (Ke), OAA angle (θ), beam width (δz), separation (Sep) between centre of OAA and Detector (Det), and the overall time-of-flight for the ions (TOF).

FIG. 13 shows the a table comparing the present invention with the prior art oa-TOF instruments of FIG. 2. All cases use our figure of Ex=500V/mm for the extraction field apart from the configuration of FIG. 2*b* where the extraction field is reduced by a factor of ten. We define a figure of merit (FOM) to be the ratio of Duty Cycle (larger the better) and turn around time δt, (smaller the better) in order to compare the present invention with the prior art. Two typical flight times (TOF) are chosen of 32 μs and 64 μs. Even in the single push (SP) case it can be seen that the present invention performs comparably or better than the embodiments of FIGS. 2*a* and 2*b*. Large advantages in duty cycle are seen in oversampled mode (OS) of operation for the various embodiments of the present invention.

Figure 14:
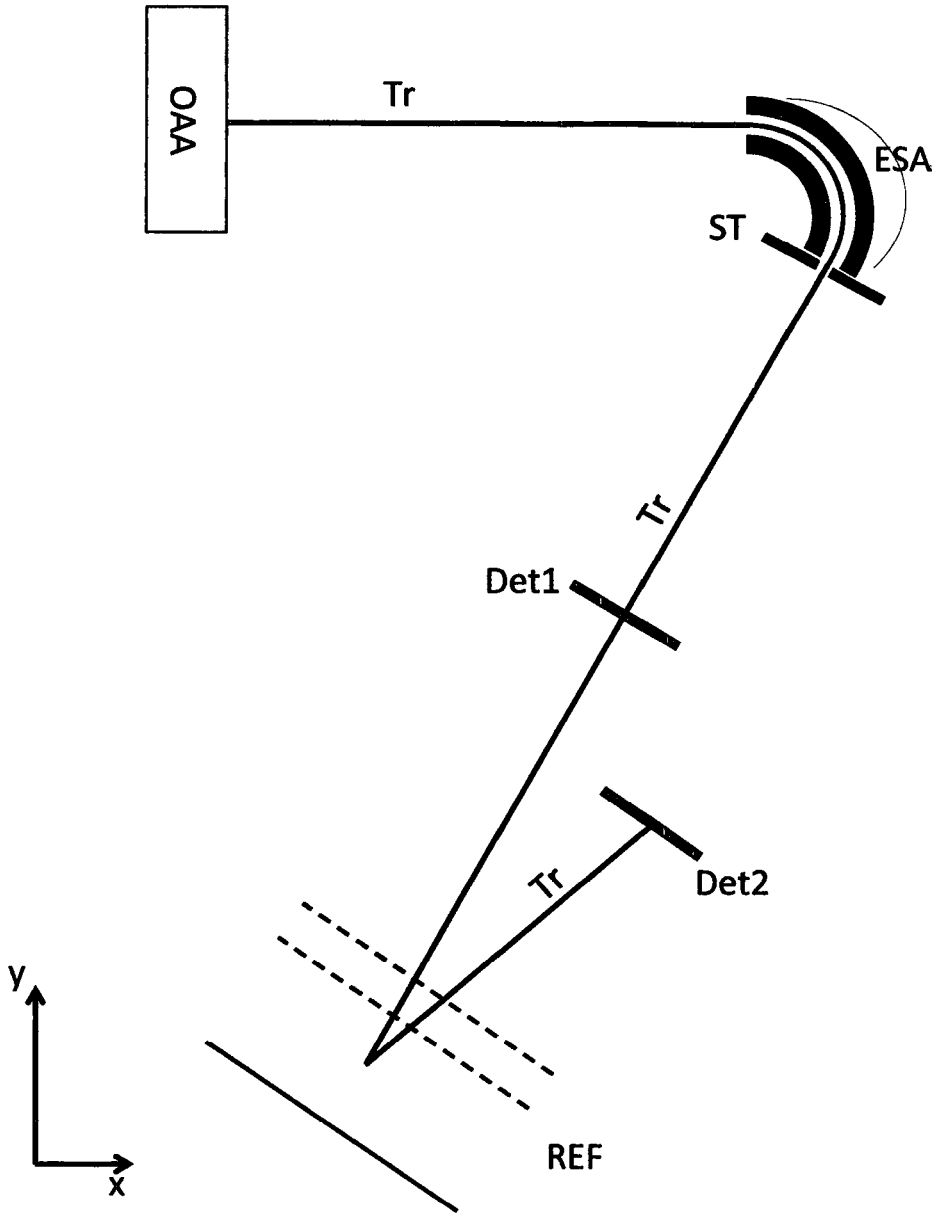
FIG. 14 shows an embodiment of the present invention comprising an ESA to filter out unwanted ions followed by a downstream Reflectron TOF analyser stage.

FIG. 14 shows an embodiment comprising an Electrostatic TOF analyser (ESA) optionally followed by a downstream Reflectron TOF analyser (REF). Unwanted ions (U) from the acceleration stage are energy filtered by the use of a slit (ST) at the exit of the ESA. The ion beam may be then sent directly to a first detector (Det1), or into a Reflectron TOF for further separation to a second detector (Det2). The xy projection shows the main beam trajectory (Tr) and the combination of ESA, field free region and Reflectron (REF) is arranged for isochronous focusing at the detector plane, such a combination is known to those skilled in the art. The downstream Reflectron based analyser may be replaced by further ESA sectors.

The present invention may be optimised for ion acceleration into multi-reflection and multi-turn analysers known in the art. The overall dimensions may be scaled to fit these analysers and successful operation with high single pulse and multiplexed duty cycles are envisaged. In some cases it may be necessary to deviate from the ideal angle θ, to accommodate these instruments, but oblique angle acceleration can still be advantageous.

It should be understood that any of the known upstream ion beam conditioning techniques may be employed before directing the incoming ion beam into the accelerator of the present invention. These include, but are not limited to: beam expanders using electrostatic einzel lenses, electrostatic quadrupole lenses and ion beam collimators. Energy spreads may be reduced by using gradually spatially decaying RF fields from upstream RF multipoles or RF ring sets. Additionally the accelerator may be interfaced to upstream ion storage devices and ion bunching devices. Such storage and bunching devices may be advantageously operated with reduced (or no) RF voltage during upstream ion beam extraction to reduce energy spreads in the ion beam before it enters the accelerator. Such ion storage devices are often used to improve duty cycles to near 100% over a limited mass range for single push mode of operation. The present invention is also amenable to interfacing with nested upstream separations such as ion mobility and ion traps.

The present invention is also amenable to the miniaturisation of TOF instruments. The reduction in turn around time as the limiting aberration reduces the demand for longer time of flights and so smaller instruments may be built. Existing mass analysers may be modified by including the pulsed accelerator of the present invention and inclining said analysers at an oblique angle (not necessarily the optimum angle according to equation 3) to the incoming ion beam. Upstream beam conditioning optics can then be modified to achieve the lower turn around time associated with the present invention to improve resolution. Such an instrument may then be operated in multiplexed (or oversampled) mode with consequentially large improvements in duty cycle.

The invention claimed is:

1. A pulsed accelerator for a Time-of-Flight mass spectrometer comprising a set of parallel electrodes wherein said set of parallel electrodes is inclined at an oblique angle to the incoming ion beam, where the oblique angle is $\theta=\tan^{-1}(\delta v_x/\delta v_z)$ where $\delta v_x$ and $\delta v_z$ are the transverse and axial velocity spreads respectively of said incoming ion beam.

2. An accelerator according to claim 1 coupled to an upstream beam conditioner such that the ratio between the axial and transverse velocity spreads of said beam is at least 2:1.

3. An accelerator according to claim 2 where said beam conditioner takes the form of a beam expander.

4. An accelerator according to claim 2 where said beam conditioner incorporates a radio frequency ion guide.

5. An accelerator according to claim 1 where the Time-of-Flight mass spectrometer includes a TOF detector and at least one of said set of parallel electrodes is configured as a deflector to deflect unwanted ions away from the TOF detector.

6. An accelerator according to claim 5 where said deflector is a Bradbury-Nielson ion gate.

7. An accelerator according to claim 1 where a potential applied to at least one of said set of parallel electrodes is raised during the acceleration cycle of the Time-of-flight mass spectrometer to compensate for field penetration leaking into an upstream region thereof to prevent perturbation of the incoming ion beam during the acceleration cycle of the Time-of-flight mass spectrometer.

8. An accelerator according to claim 1 coupled to an upstream time nested physicochemical separation device.

9. An accelerator according to claim 8 wherein said physicochemical separation is mass to charge.

10. An accelerator according to claim 8 wherein said physicochemical separation is ion mobility.

11. An accelerator according to claim 1 wherein said accelerator may be is operated in an oversampled or multiplexed mode of operation.

12. An accelerator according to claim 1 wherein unwanted ions are energy filtered downstream of said accelerator.

13. An accelerator according to claim 1 wherein said electrodes consist of a combination of wires, meshes or slit electrodes.

14. A Time-of-Flight mass spectrometer according to claim 1 wherein said Time-of-Flight mass spectrometer comprises at least one of the following: a field free region; a Reflectron; and an electric sector.

15. A method of accelerating ions comprising: directing an ion beam between a set of parallel electrodes that are inclined at an oblique angle to said beam; and pulsing a portion of said beam into a Time-of-Flight mass spectrometer, wherein the oblique angle is $\theta=\tan^{-1}(\delta v_x/\delta v_z)$ where $\delta v_x$ and $\delta v_z$ are the transverse and axial velocity spreads respectively of said incoming ion beam.

* * * * *